United States Patent [19]

Sole

[11] 4,058,395

[45] Nov. 15, 1977

[54] EXTRACTING COPPER FROM SULPHIDE CONCENTRATES

[76] Inventor: Michael John Sole, 44 Mountain View Avenue, Aldara Park, Randburg, Transvaal, South Africa

[21] Appl. No.: 720,476

[22] Filed: Sept. 3, 1976

Related U.S. Application Data

[63] Continuation of Ser. No. 507,100, Sept. 18, 1974, abandoned.

[30] Foreign Application Priority Data

Sept. 28, 1973 South Africa ..... 73/7645

[51] Int. Cl.[2] ..... C22B 15/00

[52] U.S. Cl. ..... 75/72; 75/7; 75/21; 75/63; 75/89

[58] Field of Search ..... 75/2, 5, 6, 7, 9, 21, 75/63, 72, 74, 89, 36; 423/38, 39

[56] References Cited

U.S. PATENT DOCUMENTS

| | | | |
|---|---|---|---|
| 3,585,023 | 6/1971 | Vlnaty et al. | 75/36 |
| 3,799,764 | 3/1974 | Opie et al. | 75/72 |
| 3,871,867 | 3/1975 | Last et al. | 75/2 |

*Primary Examiner*—Walter R. Satterfield
*Attorney, Agent, or Firm*—Ladas, Parry, Von Gehr, Goldsmith & Deschamps

[57] ABSTRACT

In a process for extracting copper from copper-containing sulphide concentrates the concentrate is roasted to reduce the sulphur content below 1% by weight and the roasted material is then segregated in a conventional segregation process. A silica-containing substance, such as washed river sand, is added to the roasted material to bring the silica content up to about 30% and the copper content to below 30% before feeding the material to the segregation process.

4 Claims, No Drawings

EXTRACTING COPPER FROM SULPHIDE CONCENTRATES

This is a continuation, of application Ser. No. 507,100 filed Sept. 18, 1974 now abandoned.

This invention relates to extraction of copper from sulphide concentrates.

It has already been proposed to recover copper from sulphide concentrates by first roasting the concentrate to remove sulphur and thereafter subjecting the roasted product to the segregation process.

Conventionally the sulphide concentrates approximate to chalcopytite in composition. In the prior proposal this concentrate is roasted to a sulphur content of less than 1% thus converting copper and iron to oxidic forms. The segregation reagents, usually common salt and coal or coke, are added to the roasted ore in a suitable segregation system such as the Torco system.

Unfortunately the kinetics of the process for copper recovery in the method of the prior proposal have been found to be disappointingly slow, so that for residence times normal to (say) a Torco system (less than 30 minutes) recoveries have been low. Also in some cases the material had very poor flow properties, which further complicated matters.

The present invention provides a process for the extraction of copper from copper-containing sulphide concentrates comprising the steps of roasting the concentrate to reduce the sulphur content below 1% by weight and then subjecting the roasted material to the segregation process by adding a halide salt and a reductant to the roasted material at an elevated temperature, characterized in that, an apprceciable proportion of a silica-containing substance is added to the material before being subjected to segregation.

It has been found that the silica content of the material subjected to segregation should be at least 10% and preferably of the order of 30%. Also the copper content should be lowered to be below 30%. All percentages are by weight. A wide variety of materials could be used for increasing the silica content of the roasted concentrate. In suitable cases the concentrate could be so prepared from its host rock that silica from the host rock enters the concentrate. In most cases a granular siliceous material is added. A relatively cheap additive for this purpose is river sand, which should be washed.

The invention is further illustrated by the following examples. In the case of examples 1 to 3 a concentrate of unknown origin was used. After roasting the sulphur content was below 1% and the copper content about 40%. In these three examples the reagents were 6% by weight of coal and 1% by weight of sodium chloride, except in example 2 where the coal was 8% by weight.

EXAMPLE 1

The temperature in the segregation chamber was 780° C and the residence time 30 minutes.

On the concentrate per se a copper recovery of 74.3% by weight was obtained. When 10% by weight of river sand, containing silica and feldspar, was added to the concentrate before roasting, the copper recovery was 84%. When the addition of sand was increased to 30% the recovery increased to 94.3%.

EXAMPLE 2

Segregation was conducted at 830° C also for 30 minutes. Here the percentage of coal was 8.

Without any sand addition the copper recovery was only 50.7%. When 30% sand was added the recovery rose to 86,9%.

EXAMPLE 3

Segregation was conducted at 700° C for 30 minutes.

Without any addition the concentrate yielded a copper recovery of 66.5%. When 30% by weight of Mindola North copper ore was added the total recovery from the concentrate plus ore was 86.9%. Mindola ore is characterised by its relatively high content of siliceous minerals.

In the next series of examples the experiments were conducted on a copper concentrate obtained from the Twin Buttes Mine in the United States of America. As received the concentrate had 30.4% copper, 26.5% iron and 31% sulphur. After roasting the major constituents of the material were as follows:

| Constituent. | Percentage |
|---|---|
| Copper | 35,7 |
| Iron | 30,5 |
| Sulphur | 0,36 |
| CaO | 1,09 |
| MgO | 0,90 |
| $SiO_2$ | 4,79 |
| $Al_2O_3$ | 0,82 |
| Zinc | 1,32 |

The segregation was conducted in closed silica reactors, which could be vibrated. Thirty grams of material were used for each test and the ore was heated for 15 minutes before the introduction of reagents. These were mixed by violent vibration for 1 minute and the vibrator was set at a low level for the rest of the reaction time. The reaction was stopped by plunging the closed tube into water and the product was removed and weighed.

Coarse copper was removed by wet-screening at 48 mesh, and the balance of the copper removed by a mini-flotation on the undersize. Sometimes flotation was preceded by a light grind. It should be noted that the mini-flotation process was developed as a laboratory tool which could work on very small samples of the kind here in question. Due to scale problems the results obtained are invariably worse than would be obtained on a pilot plant or full plant scale.

Preliminary tests indicated that if the roasted material was diluted with ordinary washed river sand the kinetics of the reaction improved. The river sand contained about 70 percent silica.

A series of tests were conducted on the roasted material without any diluent and with washed river sand, crushed to pass 60 mesh, as a diluent in a proportion of 30% weight. Sodium chloride was used as the halide salt and coke prepared in the laboratory from washed duff coal obtained from Landau Colliery was used as the reductant.

All percentages given below are by weight.

EXAMPLE 4

In one pair of experiments the temperature at segregation was 800° C, 10% of coke and 0.5% NaCl was added. The reaction time was 30 minutes. The results were as follows:

| | |
|---|---|
| Undiluted material: | Copper recovery 91,7%<br>Concentration of metallic copper in the tailings: 2,90% |
| Diluted Material: | Copper recovery 94,5% |

-continued

| |
|---|
| Metallic copper in tailings 2,66% |

EXAMPLE 5

In another pair of experiments the coke percentage was reduced to 4%. In this case the undiluted material yielded a recovery of 70.1% with 2.50% copper in the tailings while the diluted material yielded a recovery of 90.3% with 2.82% copper in the tailings.

EXAMPLE 6

When the coke percentage was 4 and the sodium chloride percentage 0.2, the recovery was 55.9% for undiluted material and 82.1% for diluted material. The percentage metallic copper in the tailings was 1.60 and 1.80 respectively.

Note that it is anticipated that in large scale flotation plants most of the metallic copper will be recovered.

EXAMPLE 7

At a lower temperature of 750° C using 10% coke and 0.6% salt, the undiluted material yhielded 70.7% recovered copper and 0.64% metallic copper in the tailings. No comparable experiment was conducted with diluted material, but with 10% coke and 0.5% salt and 750° C the yield was 86.8% with 2.30% metallic copper in the tailings.

EXAMPLE 8

A factorial design was carried out on a 7:3 roasted concentrate: river sand mixture. This involved 20 tests, including 4 at the zero level of the variables chosen. The zero level tests were used to assess the reproducibility of the results. Four variables were studied at the following levels:

| Variable | Level + | 0 | – |
|---|---|---|---|
| Coal Concentration | 8% | 6% | 4% |
| Salt concentration | 1,0% | 0,7% | 0,4% |
| Reaction time | 60 min. | 45 min. | 30 min. |
| Temperature | 800° C | 775° C | 750° C |

In these experiments coal was used as the reductant.

The experimental results are given in the Table below:

TABLE

RESULTS OF STATISTICALLY DESIGNED EXPERIMENTS

| Test No. | Level of Variable: Conc. Coal% | Conc NaCl% | Time Min. | Temp. ° C | Cu recovery (%) | Conc. Metallic Cu in Tailing (%) |
|---|---|---|---|---|---|---|
| 64 | 8 | 1,0 | 60 | 800 | 96,7 | 1,74 |
| 66 | 8 | 1,0 | 60 | 750 | 97,1 | 1,51 |
| 59 | 8 | 1,0 | 30 | 800 | 94,8 | 2,10 |

TABLE-continued

RESULTS OF STATISTICALLY DESIGNED EXPERIMENTS

| Test No. | Level of Variable: Conc. Coal% | Conc NaCl% | Time Min. | Temp. ° C | Cu recovery (%) | Conc. Metallic Cu in Tailing (%) |
|---|---|---|---|---|---|---|
| 58 | 8 | 0,4 | 60 | 800 | 97,2 | 1,18 |
| 63 | 4 | 1,0 | 60 | 800 | 91,6 | 1,42 |
| 54 | 8 | 1,0 | 30 | 750 | 95,5 | 1,64 |
| 57 | 8 | 0,4 | 30 | 800 | 95,8 | 1,58 |
| 61 | 4 | 0,4 | 60 | 800 | 87,3 | 0,81 |
| 70 | 4 | 1,0 | 60 | 750 | 86,6 | 0,81 |
| 62 | 4 | 1,0 | 30 | 800 | 80,5 | 0,53 |
| 65 | 8 | 0,4 | 60 | 750 | 97,1 | 1,18 |
| 53 | 8 | 0,4 | 30 | 750 | 97,5 | 0,82 |
| 60 | 4 | 0,4 | 30 | 800 | 75,9 | 0,53 |
| 68 | 4 | 0,4 | 60 | 750 | 85,8 | 0,28 |
| 69 | 4 | 1,0 | 30 | 800 | 85,6 | 0,37 |
| 67 | 4 | 0,4 | 30 | 750 | 68,9 | 0,45 |
| 55 | 6 | 0,7 | 45 | 775 | 96,6 | 1,38 |
| 56 | 6 | 0,7 | 45 | 775 | 96,7 | 1,10 |
| 71 | 6 | 0,7 | 45 | 775 | 96,8 | 1,24 |
| 72 | 6 | 0,7 | 45 | 775 | 96,7 | 1,60 |

Because of the high degree of reproducibility of the copper recoveries, at a 99% confidence level the copper recovery was found to be sensitive to all the variables, and combinations of variables as far as 4th order. The concentration of coal had the largest effect, followed by time, concentration of NaCl, and temperature. A physical interpretation of the higher effects is almost impossible to visualize.

The results for the grade of copper in the screen concentrate were affected by the concentration of coal (negative coefficient, 90% confidence level), the temperature (negative coefficient, 90% confidence level), and two third order effects, viz. concentration coal × concentration NaCl × temperature, and concentration coal × time × temperature (both negative coefficients, at 90% confidence level).

The metallic copper in the tailings was affected by the concentration of coal (positive coefficient, 99% confidence), the concentration of NaCl (positive, 90% confidence) and the product of the reagent concentrations (positive, 90% confidence).

I claim:

1. In a process for the extraction of copper from copper containing sulphide concentrates comprising the steps of roasting the concentrate to reduce the sulphur content to below 1% by weight and then treating the roasted material to the segregation process by adding a halide salt and a reductant to the roasted mterial at an elevated temperature of about 700° to 800° C. so that the copper segregates in the material in metallic form, the improvement comprising the step of adding to the material between 10 and 30% by weight of silica before subjecting the material to the segregation step, and completing said segregation step in less than about 60 minutes.

2. The process claimed in claim 1 in which the copper content of the roasted material is less than 30% by weight.

3. The process claimed in claim 2 in which the silica is added to the mterial in the form of sand.

4. The process claimed in claim 1 in which the segregation step is carried out at a temperature of about 750° to 800° C.

* * * * *